US006722001B2

(12) United States Patent
Baker

(10) Patent No.: US 6,722,001 B2
(45) Date of Patent: Apr. 20, 2004

(54) CASKET FOR AND METHOD OF MEMORIALIZING A DECEASED

(75) Inventor: Robin M. Baker, Florence, KY (US)

(73) Assignee: Batesville Services, Inc., Batesville, IN (US)

( * ) Notice: Subject to any disclaimer, the term of this patent is extended or adjusted under 35 U.S.C. 154(b) by 0 days.

(21) Appl. No.: 10/027,196

(22) Filed: Dec. 20, 2001

(65) Prior Publication Data

US 2002/0116800 A1 Aug. 29, 2002

Related U.S. Application Data

(60) Provisional application No. 60/258,336, filed on Dec. 27, 2000.

(51) Int. Cl.[7] ..... A61G 17/00

(52) U.S. Cl. ..... 27/2; 27/1; 428/913.3; 428/542.4

(58) Field of Search ..... 27/2, 19, 1, 10; D99/1, 3, 8, 15; 428/913.3, 542.4

(56) References Cited

U.S. PATENT DOCUMENTS 422,084 A * 2/1890 Learman ..... 40/124.5
494,297 A * 3/1893 Leonhardt ..... 27/2
2,835,014 A * 5/1958 Dioguardi, Jr. ..... 24/457
4,457,054 A * 7/1984 Craft et al. ..... 27/1
4,879,145 A * 11/1989 McLellan et al. ..... 428/14
5,007,148 A * 4/1991 Bida ..... 27/1
5,379,499 A * 1/1995 Jackson ..... 27/1
5,678,289 A 10/1997 Saaf
5,813,099 A * 9/1998 Stewart ..... 27/2
5,904,867 A 5/1999 Herke
6,237,202 B1 * 5/2001 Agee et al. ..... 27/14

* cited by examiner

*Primary Examiner*—William L. Miller
(74) *Attorney, Agent, or Firm*—Wood, Herron & Evans, L.L.P.

(57) ABSTRACT

A method of producing memorial items for memorializing a deceased comprises providing a casket in which to inter the deceased, providing a plaque to be presented to a loved one of the deceased as a memorial to the deceased, inscribing the casket with an inscription of memorialization and inscribing the plaque with the same inscription of memorialization. Another method of memorializing a deceased comprises providing a casket in which to inter the deceased, providing a plaque to be presented to a loved one of the deceased as a memorial to the deceased, inscribing the casket with an inscription of memorialization, inscribing the plaque with the same inscription of memorialization, interring the deceased in the inscribed casket and presenting the inscribed plaque to the loved one of the deceased. A combination of memorial items for memorializing a deceased comprises a casket and a memorial plaque, with the casket and plaque having inscribed thereon the same memorialization inscription.

15 Claims, 1 Drawing Sheet

CASKET FOR AND METHOD OF MEMORIALIZING A DECEASED

Figure 1:
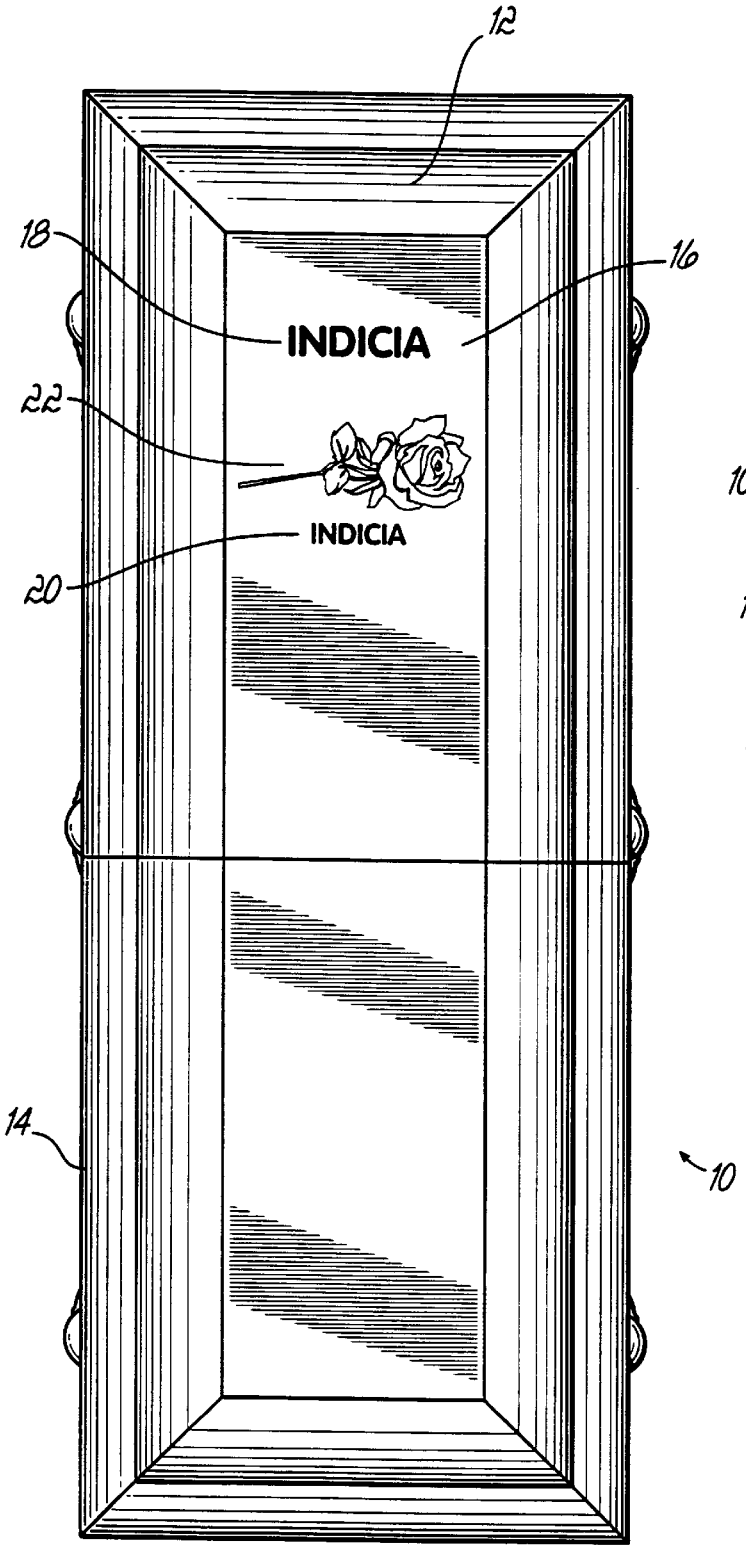

This application claims the benefit of provisional application No. 60/258,336, filed on Dec. 27, 2000.

FIELD OF THE INVENTION

This invention relates generally to the death care industry, and more particularly to caskets for and methods of memorializing a deceased.

BACKGROUND OF THE INVENTION

Upon the death of a family member the surviving loved one of the deceased must make a number of decisions, including what type of funeral or other memorial service to hold, preparation of the body, selection of a suitable casket or cremation urn, etc. In the death care industry it is conventional for those decisions to be made in a so-called "arrangement conference " In an arrangement conference, the funeral director meets with the surviving loved one of the deceased, typically in the funeral home of the funeral director, and describes to and discusses with the surviving loved one the various funeral products and services which are available. The funeral director may use visual aids such as a product catalog, product display board (such as that disclosed in the assignee's U.S. Pat. No. 5,787,626 titled Funeral Product Display Case hereby incorporated by reference herein) and a casket selection room (such as that disclosed in the assignee's U.S. Pat. No. 5,405,017 titled Modular Casket Display System and in the assignee's pending application Ser. No. 09/638,576 titled Display For A Casket Selection and/or Viewing Room both hereby incorporated by reference herein) to illustrated the products available to the customer.

There is a trend in the death care industry to make efforts towards "personalizing" the funeral products and the funeral or other memorial service purchased for the deceased. Rather than selling "cookie cutter" or "one size fits all" caskets, as one example, manufacturers and funeral directors are now beginning to manufacture and offer many "custom modular" variations thereby allowing the loved one to in essence design a specific casket especially suited to the deceased. For example, customers can select from a number of casket materials, casket finishes, casket corner adornments and casket interiors. Advances made in the area of "quick change" and "tool less" fastening mechanisms have greatly facilitated the rapid removal of one accessory from the casket and the rapid installation of another more desirable accessory to the casket. In addition to promoting personalization of the casket to the deceased, such interchangeability greatly reduces the amount of inventory the funeral director must keep on hand. An example may be seen in the assignee's pending application Ser. No. 09/660,574 titled Quick Change Casket Corner Attachment Mechanism and hereby incorporated by reference herein, commercially available from the Assignee as the LifeSymbols® line of interchangeable corner adornments.

The "custom" casket interiors available to the funeral customer today include not only the internal lining material of the casket but also the decorative cap panels that fit within the underneath of the casket cap which serve to present a visually aesthetically pleasing appearance to the underside of the cap when in the open position. The cap panel can be embroidered with a favorite saying of the deceased, a scene depicting the deceased's hobby, etc. Special cap panels have even been designed which, in addition to performing a memorial function while installed in the casket, are adapted to be presented to the loved one surviving the deceased to be displayed by the loved one in his or her home as a keepsake. See U.S. patent application Ser. No. 09/165,990 titled Dish Assembly For A Burial Casket Cap assigned to the assignee of the present invention and hereby incorporated by reference herein, the subject of which is commercially available from the Assignee as the MemoryFrame™ line of cap panels. The casket can also include a memorabilia drawer in which keepsakes of the deceased can be stored and displayed, as disclosed in the assignee's U.S. Pat. No. 5,611,124 titled Casket Having Memorabilia Compartment and hereby incorporated by reference herein, commercially available from the Assignee as the MemorySafe® line of caskets including memorabilia drawers.

Advances have therefore been made in the area of "personalization" of funeral products as demonstrated with the novel products discussed above. However, there continues to be room for improvement in the area of personalization in the death care industry.

SUMMARY OF THE INVENTION

The present invention is a method of producing memorial items for memorializing a deceased, a method of memorializing a deceased and a combination of memorial items for memorializing a deceased. The method of producing memorial items for memorializing a deceased comprises providing a casket in which to inter the deceased, providing a plaque to be presented to a loved one of the deceased as a memorial to the deceased, inscribing the casket with an inscription of memorialization and inscribing the plaque with the same inscription of memorialization.

The method of memorializing a deceased comprises providing a casket in which to inter the deceased, providing a plaque to be presented to a loved one of the deceased as a memorial to the deceased, inscribing the casket with an inscription of memorialization, inscribing the plaque with the same inscription of memorialization, interring the deceased in the inscribed casket and presenting the inscribed plaque to the loved one of the deceased.

The combination of memorial items for memorializing a deceased comprises a casket and a memorial plaque, with the casket and plaque having inscribed thereon the same memorialization inscription.

The casket and plaque may be engraved with the memorialization inscription, and may preferably be laser engraved with the memorialization inscription. The casket and plaque may also preferably be fabricated of matching wood or matching metal.

These and other features and advantages of the present invention will become more readily apparent during the following detailed description taken in conjunction with the drawings herein, in which:

BRIEF DESCRIPTION OF THE DRAWINGS OF THE INVENTION

Figure 2:
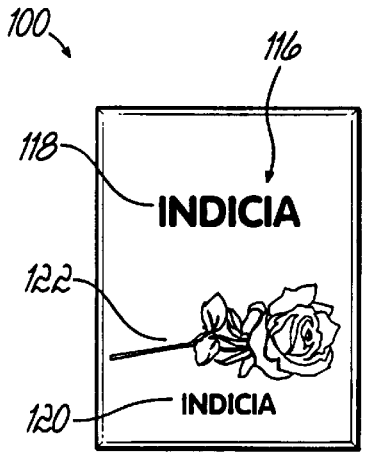

FIG. 1 is a top view of a memorialization casket according to the principals of the present invention having a memorialization inscription engraved into the head end cap thereof; and FIG. 2 is a top view of a memorialization plaque according to the principals of the present invention having a matching memorialization inscription engraved thereon.

DETAILED DISCRIPTION OF A PREFERRED EMBODIMENT OF THE INVENTION

Referring to the Figures, FIGS. 1 and 2 illustrate a casket 10 and memorial plaque 100, respectively, embodying the principals of the present invention. More particularly, casket 10 includes a lower casket shell or body (known to those skilled in the art but not shown in the top view which is FIG. 1) to which are pivotally connected a pair of caps, a head end cap or simply head cap 12 and a foot end cap or simply foot cap 14. Alternatively, the casket 10 could be of the so-called "full couch" variety wherein only a single, full length cap encloses the casket. And, by use of the term "casket," all such body containment vessels are meant to be embraced thereby, namely aboveground and below-ground burial caskets, cremation caskets, cremation containers and so-called alternative containers. In the case of the latter category, and possibly the latter two or three categories, the caps or covers are normally not pivoted to the lower shell with hardware but are merely removably closable thereon.

Describing the casket 10 of the present invention now in more detail, the head cap 12 preferably includes an inscription of memorialization 16 inscribed thereon. Alternatively the foot cap 14 may include the memorialization inscription, or the single cap of a full-couch casket or any of the various covers of cremation caskets, cremation containers or alternative containers may include the memorialization inscription. The memorialization inscription 16 may include most any combination of words or letters 18, 20 and graphics 22. Furthermore, the memorialization inscription 16 may be applied to head end cap 12 in most any desired way, such as by engraving, painting, drawing, stenciling, laminating etc. One preferable way to inscribe the head cap 12 with the inscription 16 thereon is by laser engraving. A suitable laser engraving machine with which to laser engrave the memorialization inscription thereon, whether in the case of wood caskets or sheet metal caskets is disclosed in U.S. Pat. No. 5,904,867, assigned to the assignee of the present invention and hereby incorporated by reference herein as if fully set forth in its entirety.

Describing now the memorial plaque 100 in more detail, the plaque 100 preferably is fabricated of a material which matches the material from which the casket 10 is fabricated. For example, in the event that casket is fabricated of oak, it is contemplated that plaque 100 would likewise be fabricated of oak and stained to match. In the event that the casket 10 is fabricated of sheet metal, for example bronze, it is contemplated that plaque 100 would likewise be fabricated of bronze sheet metal. In that case plaque 100 would likely be fabricated in two parts with a "base" of wood to which is attached a bronze sheet metal plate of matching finish. Like the casket 10, the plaque 100 includes an inscription 116 comprising a combination of words or letters 118, 120 and graphics 122 to match the inscription 16 on casket 10. In order that the inscription 116 matches the inscription 16, it may be required to reduce in size or to otherwise "scale down" the inscription 16 in view of the reduced surface area of the plaque 100 vis-a-vis the surface area of the head cap 12 of the casket 10.

In use of the present invention, once an order for an engraved casket is placed with a funeral home a matching plaque will preferably automatically be fabricated/assembled to match the casket chosen by the customer. To save time, a number of prefinished plaques could be held in stock by the funeral home, and once the casket finish and inscription is chosen, the appropriate material/finish plaque can be withdrawn from inventory and engraved at or about the time the casket is engraved. In the event that the funeral home does not wish to keep a stock of various plaques on hand then plaques could be made up as needed.

At the conclusion of the funeral service, such as at the grave side burial service, the plaque could ceremoniously be presented to a loved one of the deceased in much the same way that the casket locking key is presented to the loved one.

Those skilled in the art will readily recognize numerous adaptations and modifications which can be made to the present invention which will result in an improved casket for and method of memorializing a deceased, yet all of which will fall within the spirit and scope of the present invention as defined in the following claims. Accordingly, the invention is to be limited only by the scope of the following claims and their equivalents.

What is claimed is:

1. A method of producing memorial items for memorializing a deceased comprising:

providing a casket in which to inter the deceased, the casket being fabricated of a material;

providing a plaque, separate from the casket, to be presented to a loved one of the deceased as a memorial to the deceased, the plaque being fabricated of a material which matches the material of the casket;

inscribing the casket with an inscription of memorialization; and inscribing the plaque with the same inscription of memorialization.

2. The method of claim 1 wherein the casket and plaque are engraved with the memorialization inscription.

3. The method of claim 2 wherein the casket and plaque are laser engraved with the memorialization inscription.

4. The method of claim 1 wherein the casket and plaque are fabricated of matching wood.

5. The method of claim 1 wherein the casket and plaque are fabricated of matching metal.

6. A method of memorializing a deceased comprising:

providing a casket in which to inter the deceased, the casket being fabricated of a material;

providing a plaque, separate from the casket, to be presented to a loved one of the deceased as a memorial to the deceased, the plaque being fabricated of a material which matches the material of the casket;

inscribing the casket with an inscription of memorialization;

inscribing the plaque with the same inscription of memorialization;

interring the deceased in the inscribed casket; and presenting the inscribed plaque to the loved one of the deceased.

7. The method of claim 6 wherein the casket and plaque are engraved with the memorialization inscription.

8. The method of claim 7 wherein the casket and plaque are laser engraved with the memorialization inscription.

9. The method of claim 6 wherein the casket and plaque are fabricated of matching wood.

10. The method of claim 6 wherein the casket and plaque are fabricated of matching metal.

11. A combination of memorial items for memorializing a deceased comprising:

a casket, the casket being fabricated of a material; and a memorial plaque separate from said casket, the plaque being fabricated of a material which matches the material of the casket;

said casket and memorial plaque having inscribed thereon the same memorialization inscription.

12. The combination of claim 11 wherein said casket and plaque are engraved with the memorialization inscription.

13. The combination of claim 12 wherein said casket and plaque are laser engraved with the memorialization inscription.

14. The combination of claim 11 wherein said casket and plaque are fabricated of matching wood.

15. The combination of claim 11 wherein said casket and plaque are fabricated of matching metal.

* * * * *